US007089691B1

(12) United States Patent
Silvera

(10) Patent No.: US 7,089,691 B1
(45) Date of Patent: Aug. 15, 2006

(54) TECHNIQUE FOR DECORATING A SHOE AND A SHOE DECORATED USING THE TECHNIQUE

(75) Inventor: Albert J. Silvera, Manhattan Beach, CA (US)

(73) Assignee: Dynasty Footwear, Ltd., El Segundo, CA (US)

( * ) Notice: Subject to any disclaimer, the term of this patent is extended or adjusted under 35 U.S.C. 154(b) by 540 days.

(21) Appl. No.: 09/268,412

(22) Filed: Mar. 15, 1999

(51) Int. Cl.
*A43B 5/00* (2006.01)

(52) U.S. Cl. ..... 36/132

(58) Field of Classification Search ..... 36/132, 36/136; 40/636; 473/446; 446/491, 88, 446/97, 98, 268
See application file for complete search history.

(56) References Cited

U.S. PATENT DOCUMENTS

| | | | | | |
|---|---|---|---|---|---|
| 2,801,477 | A | * | 8/1957 | Adams et al. | 36/136 |
| 3,564,736 | A | | 2/1971 | Cunningham | 36/1 |
| 3,568,339 | A | * | 3/1971 | Hara et al. | 36/87 |
| 3,921,313 | A | * | 11/1975 | Mahide et al. | 36/4 |
| 4,120,101 | A | * | 10/1978 | Drew | 36/4 |
| 4,169,169 | A | * | 9/1979 | Kitabatake | 427/149 |
| 4,516,337 | A | * | 5/1985 | Adamik | 36/136 |
| 4,597,198 | A | | 7/1986 | Schweitzer | 36/100 |
| 4,697,362 | A | * | 10/1987 | Wasserman | 36/136 |
| 4,715,094 | A | | 12/1987 | Herdman | 24/119 |
| 4,852,276 | A | | 8/1989 | Savoca et al. | 36/136 |
| 5,136,726 | A | | 8/1992 | Kellin et al. | 2/244 |
| 5,209,000 | A | | 5/1993 | Rowland et al. | 36/136 |
| 5,290,043 | A | * | 3/1994 | Vidinic | 473/446 |
| 5,367,795 | A | | 11/1994 | Iverson et al. | 36/136 |
| 5,421,765 | A | * | 6/1995 | Lehmann et al. | 446/296 |
| 5,470,351 | A | * | 11/1995 | Ross et al. | 607/95 |
| 5,566,477 | A | | 10/1996 | Mathis et al. | 36/100 |
| 5,577,828 | A | * | 11/1996 | Nadel et al. | 362/103 |
| 5,601,859 | A | * | 2/1997 | Penaluna | 426/5 |
| 5,673,501 | A | | 10/1997 | Mathews | 36/136 |

(Continued)

FOREIGN PATENT DOCUMENTS

| | | | | |
|---|---|---|---|---|
| FR | 764103 | * | 2/1934 | 36/136 |

OTHER PUBLICATIONS

Creative Crystal Document, 1997.*

(Continued)

*Primary Examiner*—Mickey Yu
*Assistant Examiner*—Jila Mohandesi
(74) *Attorney, Agent, or Firm*—Mitchell Silberberg & Knupp LLP

(57) ABSTRACT

A technique is provided in which a shoe is decorated by placing a stick-on tattoo on the outer surface of the shoe. The present invention also provides a shoe having an outer portion made from one or more base materials, as well as a plain smooth plastic strip which is stitched around its entire circumference to the one or more base materials, so as to be surrounded on all edges by the one or more base materials. The present invention still further provides a method for decorating a shoe in which a first decal is applied to an outer surface the shoe, the first decal is then removed from the shoe, and a second decal is applied to the outer surface of the shoe. According to this aspect of the invention, the first decal is less than one millimeter thick, adheres well to smooth portions of the shoe, and can be removed with no more than moderate effort by only scratching with a fingernail even after adhering to a smooth portion of the shoe for more than one month.

19 Claims, 2 Drawing Sheets

U.S. PATENT DOCUMENTS 5,676,401 A * 10/1997 Witkowski et al. ..... 283/81
5,740,557 A 4/1998 Reid et al. ..... 2/209.13
5,775,007 A 7/1998 Expose ..... 36/72 B
5,800,900 A 9/1998 Mitchell ..... 428/100
5,817,385 A * 10/1998 Stanislav ..... 428/40.2
5,890,302 A * 4/1999 Kirkis ..... 36/138
5,985,383 A * 11/1999 Allen et al. ..... 428/34.1
6,032,388 A * 3/2000 Fram ..... 36/129

OTHER PUBLICATIONS

Results from computer search dated Dec. 7, 1998.

* cited by examiner

TECHNIQUE FOR DECORATING A SHOE AND A SHOE DECORATED USING THE TECHNIQUE

BACKGROUND OF THE INVENTION

1. Field of the Invention

The present invention generally relates to decorating shoes, such as sports shoes or children's shoes, and is specifically concerned with decorating a shoe with removable decals such as stick-on tattoos.

2. Description of the Prior Art

It is quite common for manufacturers to include various decorative designs on the shoes that they manufacture. For example, children's shoes typically are available with designs on their uppers and/or on visible portions of their heels. Such designs frequently include one or more decorative patterns, cartoon characters, sports team logos, or the like. Shoes having such designs are frequently quite popular, as they allow children to express their individual tastes.

Unfortunately, most such designs are permanently printed or sewn onto the shoe. As a result, if the wearer wishes to display a different design on his shoes, he must then purchase a different shoe bearing the desired design. However, this can be costly and often impractical. Consequently, it would be desirable to have a technique that would permit a pair of shoes to be decorated once, and then when the owner's taste changes or when the owner merely tires of that design, he could remove the design and replace it with another.

In the past, various attempts have been made to achieve this goal. However, each of these conventional attempts has had problems that made them largely impractical. For instance, U.S. Pat. No. 4,852,276 concerns a shoe in which an insert having a design or logo is inserted in a frame on the shoe. Specifically, with this technique the insert is held in place using a combination of a lip portion of the frame and a pressure sensitive adhesive. However, this conventional technique has the disadvantage that the insert can be difficult for a child to place underneath the frame's lip. Furthermore, with this conventional technique the owner is constrained to use only inserts that are specifically sized for the shoe's insert frame.

Other techniques have used magnetic material (U.S. Pat. No. 5,740,557), velcro (U.S. Pat. No. 5,566,477), a combination of a frame having a lip and velcro (U.S. Pat. No. 5,800,900) and snaps (U.S. Pat. No. 5,673,501) to attach decorative articles to a shoe. However, magnetic material frequently does not hold well; a frame with a lip can be difficult to use, as noted above; and using velcro or snaps tends to make the decorative article protrude too far away from the shoe, increasing the likelihood that the decorative article will be pulled off if another object rubs against the shoe.

As a further alternative conventional attempt, U.S. Pat. No. 5,209,900 describes a shoe having a removable decorated shoelace cover, which is attached to the shoe by looping shoelaces through slots in the shoelace cover. However, with this technique the decorative article generally can only be placed over the shoelaces, thus severely limiting the shoe owner's ability to creatively decorate his shoes.

What is needed, therefore, is a more practical and easier to use technique for decorating and re-decorating shoes as desired.

SUMMARY OF THE INVENTION

The present invention addresses the foregoing need by providing a technique in which a shoe is decorated by placing a stick-on tattoo on the outer surface of the shoe. Specifically, the foregoing technique provides a novel method by which decorations can be applied to a shoe, generally will adhere well after application, and then often can be removed with only moderate effort.

The present invention also addresses the foregoing needs by providing a decorated shoe having an outer surface that includes a smooth portion and a stick-on tattoo attached to the smooth portion of the outer surface of the shoe. According to this aspect of the invention, the stick-on tattoo frequently adheres well under most conditions; then, when removal is desired, the stick-on tattoo often can be removed with only moderate effort, allowing the shoe to be re-decorated.

The present invention still further addresses the foregoing needs by providing a shoe having an outer portion made from one or more base materials, as well as a plain smooth plastic strip that is stitched around its entire circumference to the one or more base materials, so as to be surrounded on all edges by the one or more base materials. Thus, this aspect of the invention provides a shoe that is well-suited to application and removal of decals, such as stick-on tattoos.

The present invention still further addresses the foregoing conventional needs by providing a method for decorating a shoe in which a first decal is applied to an outer surface the shoe, the first decal is then removed from the shoe, and a second decal is applied to the outer surface of the shoe. According to this aspect of the invention, the first decal is less than one millimeter thick, adheres well to smooth portions of the shoe, and can be removed with no more than moderate effort by only scratching with a fingernail even after adhering to a smooth portion of the shoe for more than one month. Thus, this aspect of the invention avoids the situation, common in certain conventional techniques, in which the decorative article protrudes too far away from the shoe. At the same time, this aspect of the invention can permit a decorative article (i.e., decal) to be applied to a shoe, removed with only moderate effort, and then replaced with a different decorative article (i.e., decal), often at the same position at which the first decal was originally placed.

The foregoing summary is intended merely to provide a quick understanding of the general nature of the present invention. A more complete understanding of the invention can only be obtained by reference to the following detailed description of the preferred embodiment in connection with the accompanying drawings.

DESCRIPTION OF THE PREFERRED EMBODIMENT(S)

Figure 1A:
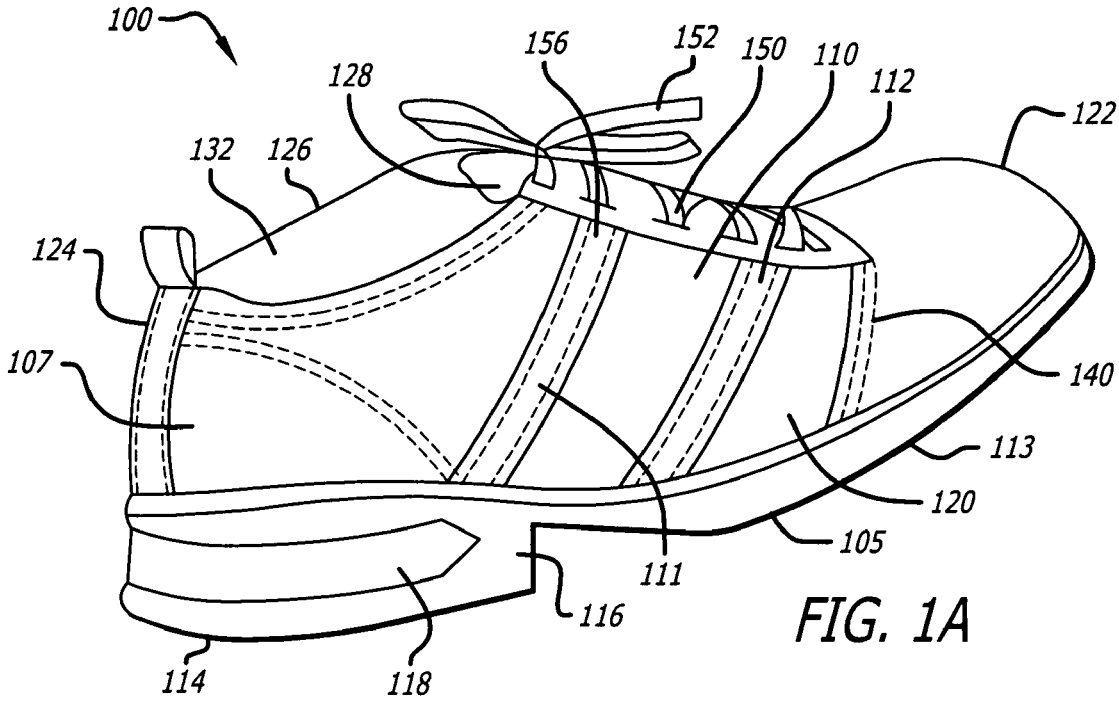
FIG. 1A is a perspective view of a shoe according to a representative embodiment of the present invention.
Figure 1B:
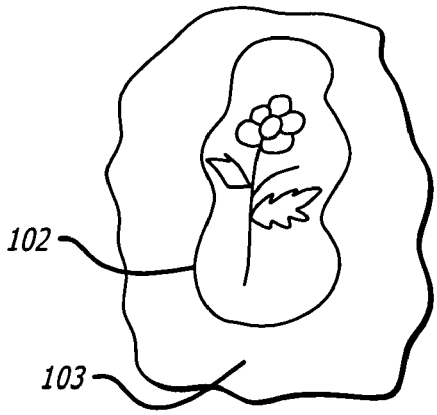
FIGS. 1B and 1C are top plan views of a pair of removable tattoos according to the present invention.
Figure 1C:
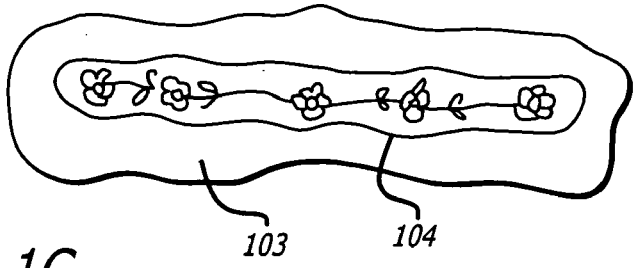

Reference is now made to the drawings wherein like numerals refer to like elements throughout. FIGS. 1A to 1C illustrate a representative embodiment of a shoe 100 and two removable decals 102 and 104 for use in the present invention.

As illustrated in FIG. 1A, shoe 100 has a lower portion 105 and an upper portion 107 attached to the lower portion 105. Lower portion 105, which includes a sole 113 and a heel 114, may be formed as a single piece comprising the sole 113 and the heel 114. Alternatively, sole 113 and heel 114 may be formed separately and then adhered together, such as by using any of a number of well known adhesives. In the illustrated embodiment, heel 114 includes a side wall 116 upon which at least one recessed area 118 is formed. Lower portion 105 preferably is primarily made from a rubber material (e.g., cured natural or synthetic), a polyurethane elastomer or other similar suitable materials. However, for reasons which will become clear below, a piece of material having a smooth surface preferably is fitted and bonded into recessed area 118, so as to form a smooth surface within recessed area 118.

Preferably, the recessed area 118 is elongated in the horizontal direction, extending at least half the length of the side wall 116. More preferably, the recessed area 118 extends at least three-fourths the length of the side wall. Most preferably, the recessed area extends over 80% of the length of the side wall. The recessed area 118 preferably is uniform in depth and has a uniform surface, and preferably is at least 0.2 millimeter deep, more preferably is at least 0.5 millimeter deep, even more preferably is at least 0.8 millimeter deep, and most preferably is at least 1.0 millimeter deep. In addition, it is preferred that the recessed area 118, for most of its length, be at least one centimeter wide. More preferably, the recessed area, for most of its length, is at least 1.2 centimeters wide. Alternatively, the recessed area 118, for at least 2 centimeters of its length, is preferably at least one centimeter wide, or more preferably, at least 1.2 centimeters wide. In another respect, it is preferred that the area of the surface of the recessed area be in excess of 10 square centimeters. A long and wide recessed area has the advantages of allowing easy application of the piece of material therein and is more eye-catching and interesting. The recessed area can also comprise geometric shapes other than the specific shape shown in FIG. 1A such as, for example, elongated ovals. Again, irrespective of the particular geometric shape of the recessed area, it is preferred that the recessed area have the dimensions discussed above in this paragraph. In addition, there can be more than one recessed area in the side wall 116. For example, there might be two recessed areas in the side wall, one in each side of the heel. In the case of multiple recessed areas, it is be preferred that, in the vertical direction, each recessed area have an average width of at least one centimeter. Even more preferably, each recessed area has an average width of at least 1.2 centimeters. Also in the case of multiple recessed areas, it is preferred that the sum of the length of the recessed areas, in the horizontal direction around the heel, total at least 50% the length of the side wall. It is further preferred that, at least, each multiple recessed area have a length in the horizontal direction of at least 15% of the length of the side wall.

Each material having a smooth surface (i.e., a smooth material) mentioned herein preferably is a smooth polymer material (e.g., plastic) and, more preferably, is made from polyvinyl chloride (PVC). Moreover, each such material having a smooth surface preferably is cut from a sheet of smooth material (e.g., smooth polymer sheet material, such as a PVC sheet material). In the preferred embodiment, the smooth material is clear, white, or clear with the underlying material being white (so that the net reflected color is white). Furthermore, each such smooth material preferably is flexible. Typically, the PVC sheet material used in the present invention will be comprised of a combination of PVC resin, a plasticizer (such as phthalate), a stabilizer (such as barium/zinc or cadmium/barium/zinc complex) and, if necessary, one or more pigments. As used herein, a smooth surface preferably means sufficiently smooth to enable an ordinary stick-on tattoo to adhere well to the surface and also to enable such a stick-on tattoo to be removed with only moderate effort by scraping with a fingernail or by washing with water alone or water in combination with soap.

In order to facilitate application of decals, it is preferable that the smooth surfaces, as well as any recessed areas into which such smooth surfaces are inserted, are curved in at most one dimension. Thus, as shown in FIG. 1A, recessed area 118 is curved along its length, but not along its width.

Upper portion 107 of shoe 100 may be formed as a single piece or, alternatively, may be formed by attaching different pieces, such as by stitching, gluing or both. In the present embodiment, the different pieces comprising upper portion 107 are attached using stitching 140. Shoe 100 illustrated in FIG. 1A includes the following pieces: a quarter piece 120, a tip piece 122, a heel strip 124, a collar 126 and a tongue 128. The collar 126 and the tongue 128 define an opening 132 in the upper portion 107 through which a foot (not shown) can be received into shoe 100. In the present embodiment, the remainder of shoe 100 is substantially closed. However, shoe 100 may include other open portions, such as is common with sandal-type shoes.

Formed in the top of quarter piece 120 are eyelets 150 for lacing shoelace 152, which is used for tightening shoe 100 around a foot. However, it should be noted that other tightening means may instead be used, such as straps and buckles, velcro or various types of clips.

In the embodiment shown in FIG. 1A, at least two different types of materials are used to form upper portion 107. At least some of the pieces, such as piece 110, are formed from a material having a smooth surface, as described above. The remaining pieces may be formed from other conventional base materials, which are typically cut from sheets of material, such as natural or synthetic leather or a similar flexible material. FIG. 1B illustrates a removable decal 102 for use in the present invention. Preferably, decal 102 is less than 1 millimeter (mm) thick, more preferably is less than 0.5 mm thick, and even more preferably is less than 0.2 mm thick. In the preferred embodiment, removable decal 102 is an ordinary stick-on tattoo, such as is commonly applied to skin. Stick-on tattoo 102 preferably is formed as a film-like material (often referred to as tacky material) and is deposited onto a suitable substrate 103, such as paper. Such stick-on tattoos are well known in the art and can be formed, for example, as a combination of a PVA-copolymer, polyester resin, modified varnish, deodorized petroleum, silicon dioxide, aluminum silicate iron oxide, and various dyes. One present representative brand of stick-on tattoos usable in practicing the present invention is sold under the trademark Skin Wear® by Johnson & Mayer, Inc., of Hackensack, N.J.

In the present embodiment, decal 104 is identical in composition to decal 102, but has been formed with a different size, shape and design. However, the present invention also contemplates using stick-on tattoos having different compositions for decorating the same shoe. Also, in the present embodiment of the present invention, stick-on tattoos 102 and 104 are shown comprising floral designs. However, it will be appreciated that tattoos 102 and 104 may include any arbitrary designs, such as decorative patterns, cartoon characters, sports team logos, or the like.

Decals, such as stick-on tattoos 102 and 104, can be applied to any portion of shoe 100 having a smooth surface, and can be subsequently removed (cleaned) and replaced with a different tattoo to thereby create a different appearance for the shoe 100. In one exemplary application process, tattoo 102 is initially positioned against a portion of shoe 100 having a smooth surface, and then the back (i.e., the paper substrate 103 side) of the tattoo 102/substrate 103 combination is wetted with water using a sponge or a cloth. Subsequently, after approximately 10 seconds, the paper 103 can be removed (peeled) to leave the tattoo 102 on the smooth surface of the shoe 100. Because the stick-on tattoo is formed from a film-like material, it can adhere to surfaces without the need for a separate adhesive. Thereafter, the tattoo 102 can be removed simply by scratching with a fingernail or washing with water alone or with soap and water. As a result of this simple process, a single pair of shoes can be decorated and redecorated a number of times.

Figure 2:
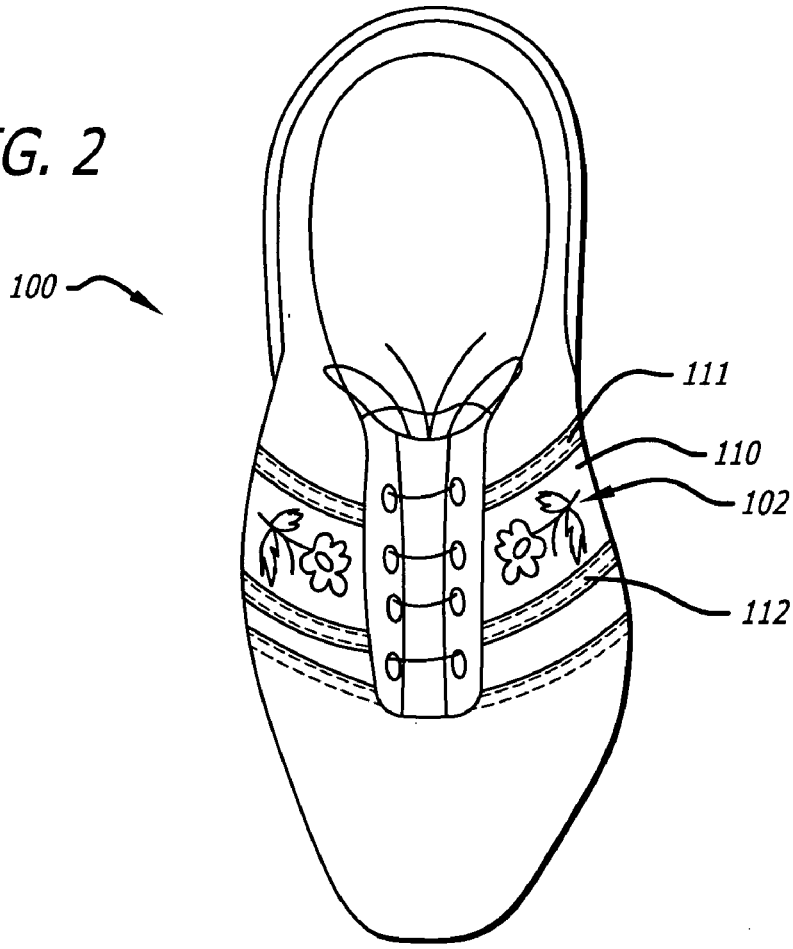
FIG. 2 is a top plan view of the shoe shown in FIG. 1A with the tattoo shown in FIG. 1B having been applied to a smooth surface on the upper portion of the shoe.
Figure 3:
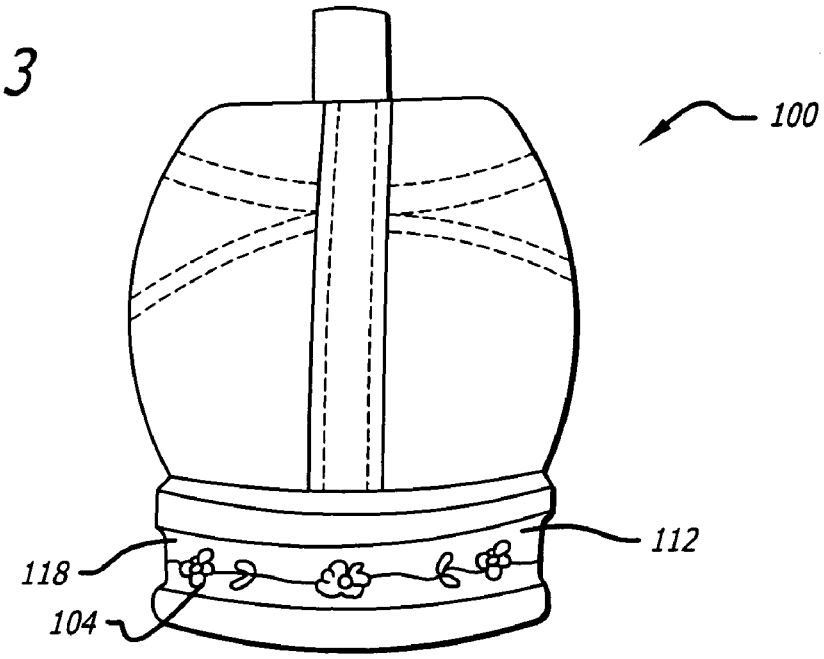
FIG. 3 is a rear view of the shoe shown in FIG. 1A, with the tattoo shown in FIG. 1C having been applied to a smooth surface on the heel of the shoe.

FIG. 2 is a top plan view of shoe 100 with stick-on tattoo 102 applied to the smooth surface of piece 110 of upper portion 107. FIG. 3 is a back view of shoe 100 illustrating heel side wall 116 with tattoo 114 applied to the smooth surface of recessed portion 118. As noted above, piece 110 is formed from a material having a smooth surface, and recessed portion 118 has bonded onto it a material having a smooth surface. Both such smooth materials preferably are cut from sheets of a PVC material.

As discussed above, in accordance with the present invention, decorations can be repeatedly applied to and then removed from shoes, allowing the owner to have a number of different designs without the necessity of purchasing a new pair of shoes for each new design. In addition, the present invention provides a technique whereby a very thin decal can be applied to shoes and then later removed with no more than moderate effort by only scratching with a fingernail. In fact, such easy removal generally will be possible even after the decal has adhered to a smooth portion of the shoe for more than one month.

Although the present invention has been described in detail with regard to the exemplary embodiments and drawings thereof, it should be apparent to those skilled in the art that various adaptations and modifications of the present invention may be accomplished without departing from the spirit and the scope of the invention. Accordingly, the invention is not limited to the precise embodiment shown in the drawings and described in detail hereinabove. Rather, it is intended that all such variations not departing from the spirit of the invention be considered as within the scope thereof as limited solely by the claims appended hereto.

For instance, the shoe in the representative embodiment described above is made from pieces of at least two different types of materials attached together at their edges, where at least one has a smooth surface. However, it will be obvious to those skilled in the art that the shoe may instead be formed from a single type of material having a smooth surface. Similarly, the shoe may first be formed from a base material such as leather or synthetic leather and then coated in whole or in part with a material having a smooth surface, such as by bonding or stitching a smooth sheet material over the base material.

In the following claims, those elements which do not include the words "means for" are intended not to be interpreted under 35 U.S.C. § 112 ¶6.

What is claimed is:

1. A method for decorating a shoe, comprising:

wetting a stick-on tattoo; and applying the stick-on tattoo to a smooth portion of an outer surface of the shoe, wherein the stick-on tattoo does not include separate adhesive material, and wherein the stick-on tattoo is applied to the shoe without using separate adhesive material.

2. A method according to claim 1, wherein the stick-on tattoo is comprised of a combination of a copolymer and a polyester resin.

3. A method according to claim 1, wherein the smooth portion of the outer surface of the shoe is comprised of polyvinyl chloride (PVC).

4. A method according to claim 1, further comprising steps of removing the stick-on tattoo from the shoe and applying a second stick-on tattoo to the shoe.

5. A method according to claim 1, wherein the stick-on tattoo is applied to a portion of the outer surface of the shoe that is white.

6. A method according to claim 1, wherein the stick-on tattoo is applied to a portion of the outer surface of the shoe that is clear.

7. A method according to claim 1, wherein the stick-on tattoo can be removed with no more than moderate effort by only scratching with a fingernail even after adhering to the shoe for more than one month.

8. A method according to claim 1, wherein the stick-on tattoo is comprised of a film-like material.

9. A method according to claim 1, wherein the smooth portion of the outer surface of the shoe is comprised of plastic.

10. A decorated shoe, comprising:

a shoe having an outer surface which includes a smooth portion; and a stick-on tattoo attached to the smooth portion of the outer surface of the shoe, wherein the stick-on tattoo does not include separate adhesive material and adheres to the shoe without use of separate adhesive material.

11. A decorated shoe according to claim 10, further comprising a recessed portion; wherein the smooth portion of the outer surface of the shoe is disposed within the recessed portion.

12. A decorated shoe according to claim 11, wherein the recessed portion has an average width of at least 1.2 centimeters.

13. A decorated shoe according to claim 11, wherein the recessed portion has a surface area in excess of 10 square centimeters.

14. A decorated shoe according to claim 10, wherein the smooth portion of the outer surface of the shoe is comprised of polyvinyl chloride (PVC).

15. A decorated shoe according to claim 10, wherein the stick-on tattoo is comprised of a combination of a copolymer and a polyester resin.

16. A decorated shoe according to claim 10, wherein the smooth portion of the outer surface of the shoe approximately matches the stick-on tattoo in size.

17. A decorated shoe according to claim 10, wherein the smooth portion of the outer surface of the shoe is stitched into the outer portion of the shoe.

18. A decorated shoe according to claim 10, wherein the stick-on tattoo is comprised of a film-like material.

19. A decorated shoe according to claim 10, wherein the smooth portion of the outer surface of the shoe is comprised of plastic.

* * * * *